US012606344B1

(12) United States Patent
Ouimet et al.

(10) Patent No.: US 12,606,344 B1
(45) Date of Patent: Apr. 21, 2026

(54) VITAMIN AND SUPPLEMENT DISPENSING SYSTEM

(71) Applicant: Phi Health Sciences, Inc., Salt Lake City, UT (US)

(72) Inventors: Kirk Ouimet, Salt Lake City, UT (US); Jason Klug, Salt Lake City, UT (US)

(73) Assignee: Phi Health Sciences, Inc.

( * ) Notice: Subject to any disclaimer, the term of this patent is extended or adjusted under 35 U.S.C. 154(b) by 0 days.

(21) Appl. No.: 19/263,384

(22) Filed: Jul. 8, 2025

Related U.S. Application Data

(60) Provisional application No. 63/800,684, filed on May 6, 2025.

(51) Int. Cl.
*B65D 1/36* (2006.01)
*B65D 5/50* (2006.01)

(52) U.S. Cl.
CPC ..... *B65D 5/503* (2013.01)

(58) Field of Classification Search
CPC ..... B65D 1/36; B65D 5/503
USPC ..... 206/485, 538, 559, 560, 564–565, 804
See application file for complete search history.

(56) References Cited

U.S. PATENT DOCUMENTS 3,272,371 A * 9/1966 Weiner ..... B65D 71/70 206/443
3,589,511 A * 6/1971 Britt ..... B65D 1/36 206/561
7,556,152 B2 * 7/2009 Lechelle ..... B65D 75/24 206/509
2007/0007162 A1 1/2007 Buller
2007/0074989 A1 * 4/2007 Merboth ..... A61F 2/0095 206/438
2011/0014351 A1 1/2011 Reider
2013/0022951 A1 1/2013 Hughes
2016/0198990 A1 * 7/2016 Betancur ..... B01L 9/06 206/363
2021/0082019 A1 3/2021 Versano et al.
(Continued)

OTHER PUBLICATIONS

Koviuu Organizer Detachable Medication Supplement Case, Amazon.com, May 2024, Product detail page, ASIN: B0DCP4RHL9, Amazon.com Services LLC, United States. Available at: https://www.amazon.com/KOVIUU-Organizer-Detachable-Medication-Supplement/dp/B0DCP4RHL9.

(Continued)

*Primary Examiner* — Luan K Bui
(74) *Attorney, Agent, or Firm* — Headland Law & Strategy; Matthew J. Smyth

(57) ABSTRACT

A system may include a plurality of holders and a tray having a plurality of receptacles that each removably receive one of the holders. Each holder may have a retention portion with outer walls that enclose a continuously smooth inner bore. The continuously smooth inner bore may have a substantially uniform cross-section. The holder may have a removable top cap with a top closure portion and a bottom safety ring that is coupled to the top closure portion with one or more break-away tabs. The tray may have a top planar rim. Each receptacle in the plurality of receptacles may have a contoured bottom surface whose height varies relative to the top planar rim. The height may vary from a first height at a lower leg region, a second height at a mid-bore support region, and a third height at an upper support region.

13 Claims, 9 Drawing Sheets

(56) References Cited

U.S. PATENT DOCUMENTS

2022/0359057 A1 11/2022 Myers

OTHER PUBLICATIONS

Organizer Koviuu Rotatable Container for Medication and Supplement Storage, Amazon.com, Jan. 2023, Product detail page, ASIN: B0BX45Q3DN, Amazon.com Services LLC, United States. Available at: https://www.amazon.com/Organizer-KOVIUU-Rotatable-Container-Supplement/dp/B0BX45Q3DN.

* cited by examiner (Section A-A)

(Section B-B)

VITAMIN AND SUPPLEMENT DISPENSING SYSTEM

CROSS REFERENCE TO RELATED APPLICATIONS

This application claims priority to U.S. Application Ser. No. 63/800,684, titled "Vitamin and Supplement Dispensing System," filed on May 6, 2025. This application incorporates the entire contents of the foregoing application herein by reference.

TECHNICAL FIELD

Various implementations relate generally to systems for shipping, displaying and dispensing vitamins and supplements.

BACKGROUND

Vitamins and supplements are available in many forms, including, for example, pills, tablets, capsules, softgels, gummies, powders, liquids, microspheres, microbeads, patches, etc. Users may regularly order combinations of such vitamins and supplements, and such combinations may be regularly delivered in bottles, pill packs, refillable containers, blister packs, powder sachets, ampules, patches, etc.

SUMMARY

A system may include a plurality of holders and a tray having a plurality of receptacles, where each receptacle is configured to removably receive one of the plurality of holders. Each holder may have a retention portion with outer walls that enclose a continuously smooth inner bore and that is characterized by a holder length, a closed bottom and a removable top. The continuously smooth inner bore may have, across the length, a substantially uniform cross-section. In some implementations, the uniform cross-section is in the form of a squircle. The holder may have on an exterior surface at the removable top, a plurality of thread ramps, a plurality of snap-fit grooves, and a plurality of snap-fit retention recesses. The holder may have a removable top cap with a top closure portion and a bottom safety ring that is coupled to the top closure portion with one or more break-away tabs. An inner recess of the removable top cap may have a plurality of thread grooves that interface with the plurality of thread ramps, a plurality of snap-fit detents that interface with the plurality of snap-fit grooves, and a plurality of snap-fit tabs that interface with the plurality of snap-fit retention recesses. The tray may have a top planar rim. Each receptacle in the plurality of receptacles may have a contoured bottom surface whose height varies relative to the top planar rim. In some implementations, the height varies from a first height at a lower leg region, a second height at a mid-bore support region, and a third height at an upper support region. The top planar rim may include at least one access cutout along a perimeter of the top planar rim.

In some implementations, each of the thread ramps in the plurality of thread ramps has a chamfered edge, and each of the thread grooves in the plurality of thread grooves has a corresponding chamfered recess. The thread ramps, thread grooves, chamfered edges and chamfered recesses may be configured such that the removable top cap can be snap-fit onto the retention portion such that the thread ramps are disposed in the thread grooves. The thread ramps and thread grooves may be further configured such that once the removable top cap is snap-fit onto the retention portion, rotation of the removable top cap relative to the retention portion causes the removable top cap to separate from the retention portion, causing the break-away tabs to break, thereby separating the top closure portion and the bottom safety ring. The snap-fit grooves and snap-fit detents may be configured to recouple, with a snap fit connection, the removable top cap to the retention portion even after the break-away tabs are broken. A compressible sealing pad may be provided between the retention portion and the removable top cap.

In some implementations, the system may further include a shipping package that holds a plurality of trays, each tray in the plurality of trays removably securing holders within each receptacle. The plurality of trays may be stacked on top of each other, such that the bottom contoured surface of an upper tray contacts holders disposed within a lower tray at the lower leg region and the upper support region, thereby allowing the plurality of trays to be stacked with their respective top planar rims being parallel to each other. A shipping package may hold a first stack of trays and a second stack of trays. When the first stack of trays is disposed 180 degrees relative to the second stack of trays, access cutouts in the first stack of trays may align with the access cutouts in the second stack of trays.

A display container that is configured to snugly receive one tray from the plurality of trays in the shipping package may be further included in the system. The display container may have an upper perimeter edge, and a cavity that is configured to receive the one tray such that the upper planar rim of the one tray is spaced apart from and below the upper perimeter edge by a spacing gap. A secondary holder may be included with a top surface, a receptacle that extends down from the top surface, and a secondary-holder bottom surface. An alignment boss may extend down from the secondary-holder bottom surface a distance equal to or less than the spacing gap. The alignment boss may be configured to snugly engage with the cavity when the secondary holder is stacked on top of the display container.

The contoured bottom surface may be configured such that when a specific holder is disposed in a specific receptacle, opposing forces applied at the mid-bore support region of the specific receptacle and the closed bottom of the specific holder cause the removable top of the specific holder to rotate upward to facilitate extraction of the specific holder from the specific receptacle. The contoured bottom surface of the specific receptacle may be configured to create a lower-leg gap between the contoured bottom surface and the closed bottom of the specific holder, to facilitate upward rotation of the specific holder when the opposing forces are applied.

DETAILED DESCRIPTION

Disclosed herein are systems for shipping, displaying and dispensing vitamins, minerals and supplements ("nutrients"). In some implementations, systems are used for providing to users customizable weekly or monthly packages of specifically tailored nutrients. For example, the systems may be used to provide users with a monthly supply of nutrients for daily and nightly consumption.

Figure 1:
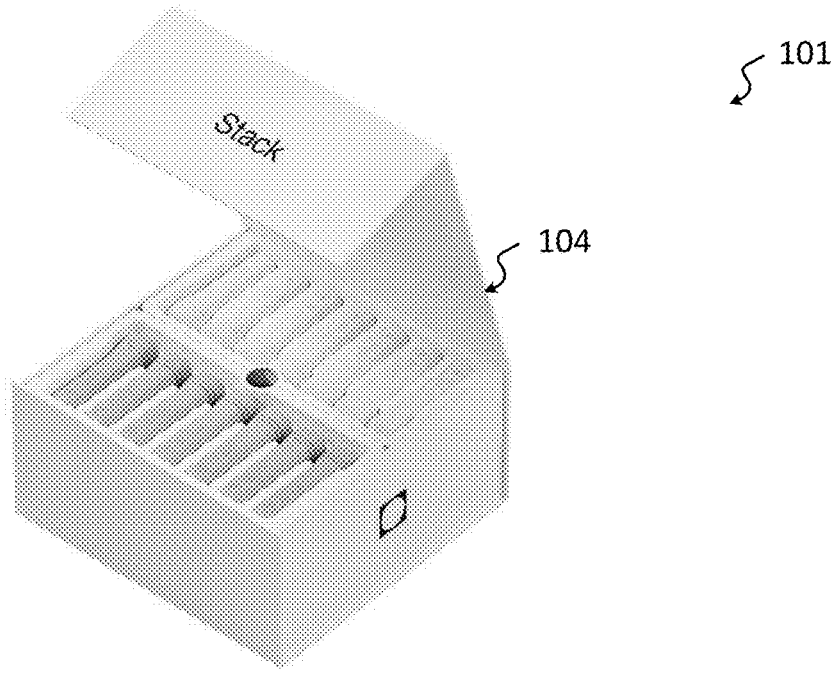
FIG. 1 illustrates an exemplary system through which nutrients may be provided to users.
Figure 2:
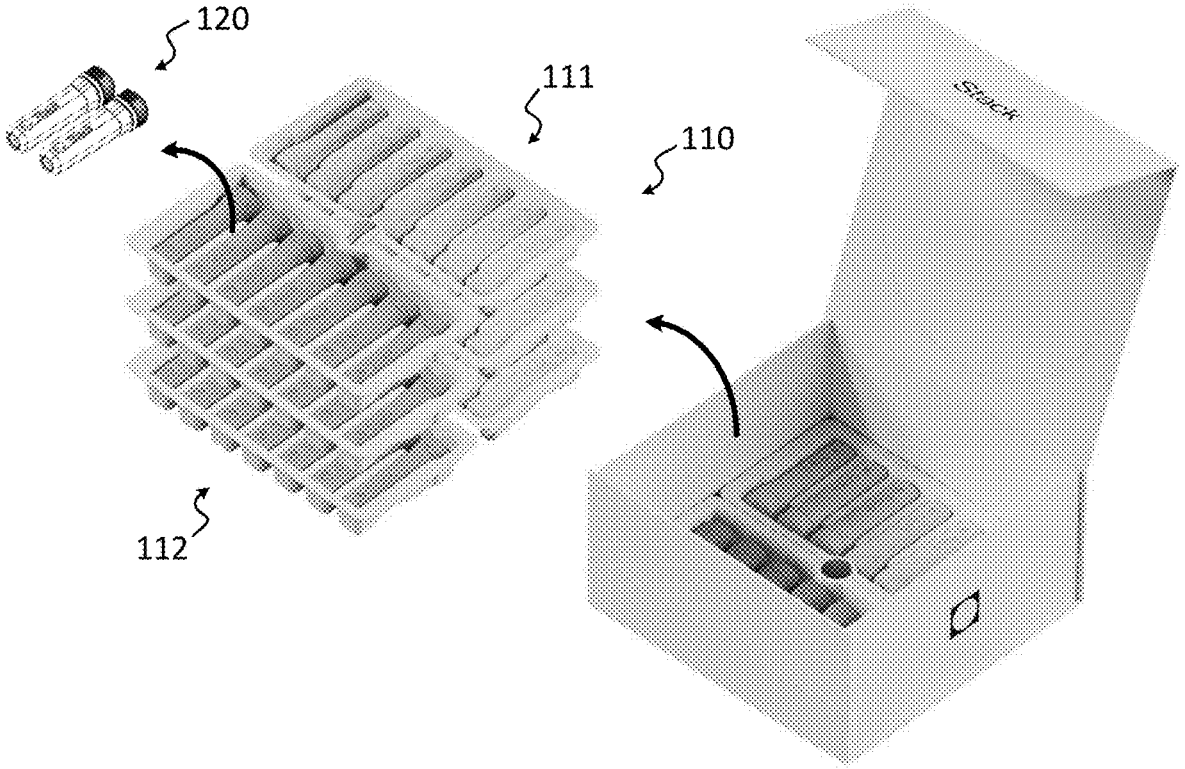
FIG. 2 illustrates additional details of the exemplary system of FIG. 1.

FIGS. 1-2 illustrates an exemplary system 101 through which nutrients may be provided to users. The system 101 may include a recurring shipment of nutrients to users (e.g., on a monthly, 28-day, weekly or quarterly basis). In some implementations, the system 101 includes a shipping package 104 that is provided to users that includes a plurality of trays 110, where each tray includes a plurality of holders 120 that contain the nutrients. Different nutrients may be provided for different times of the day, week or month. For example, in one implementation, as depicted, two sets of nutrients may be provided for each day—one for consumption during the daytime, and one for consumption at nighttime. More particularly, daytime nutrients may be organized within the shipping package 104 as a first stack 111 of trays, and nighttime nutrients may be organized within the shipping package 104 as a second stack 112 of trays. In another implementation, different nutrients may be provided for a specific week (e.g., during a week of ovulation by a user) or for specific days (e.g., special nutrients for weekend consumption that are different than nutrients for weekday consumption; special nutrients for an athlete for specific training or competition days; etc.). Trays 110 or holders 120 or both may be color-coded to distinguish between different doses, nutrients or blends for different times, days or weeks.

Figure 3:
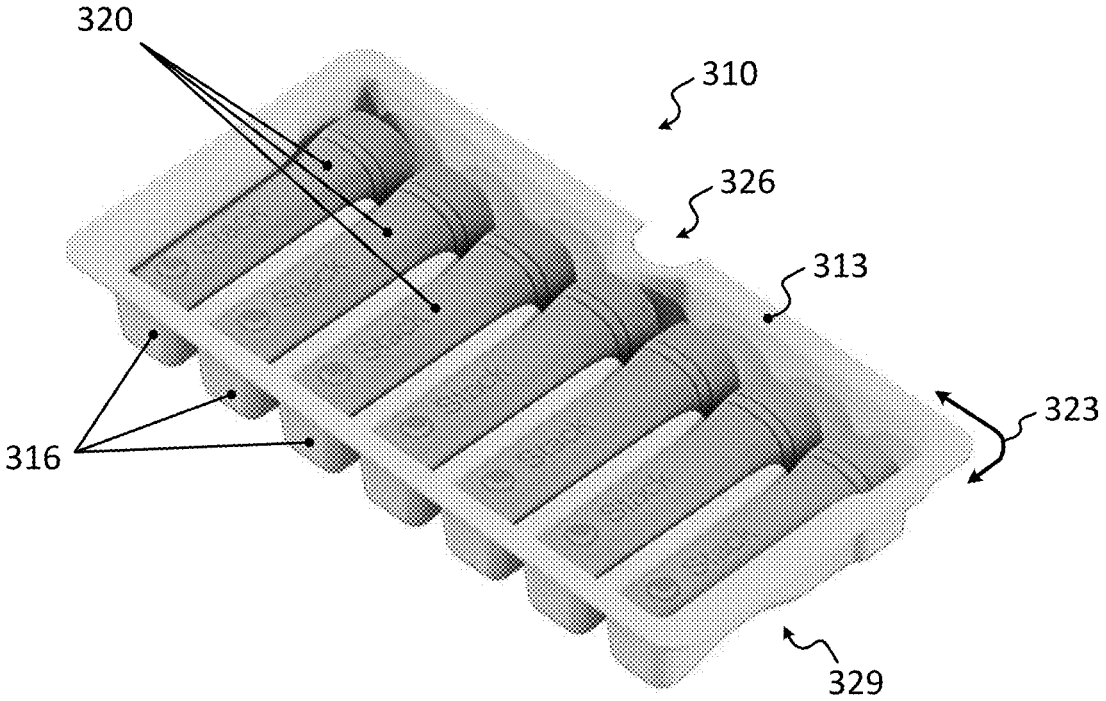
FIG. 3 is a perspective view an exemplary tray.

FIGS. 3-9 illustrate additional details of an exemplary tray 310. As shown in FIG. 3, the tray 310 includes a top planar rim 313 and a plurality of receptacles 316 into which are retained a plurality of holders 320. Along a perimeter 323, an access cutout 326 may be provided to facilitate handling and removal of the tray 310 from a stack of trays within a shipping package. As shown, the tray 310 further includes a contoured bottom surface 329. Additional details of the contoured bottom surface are provided with reference to the cross-sections shown in FIG. 4—specifically, cross-section A-A and cross-section B-B.

Figure 4:
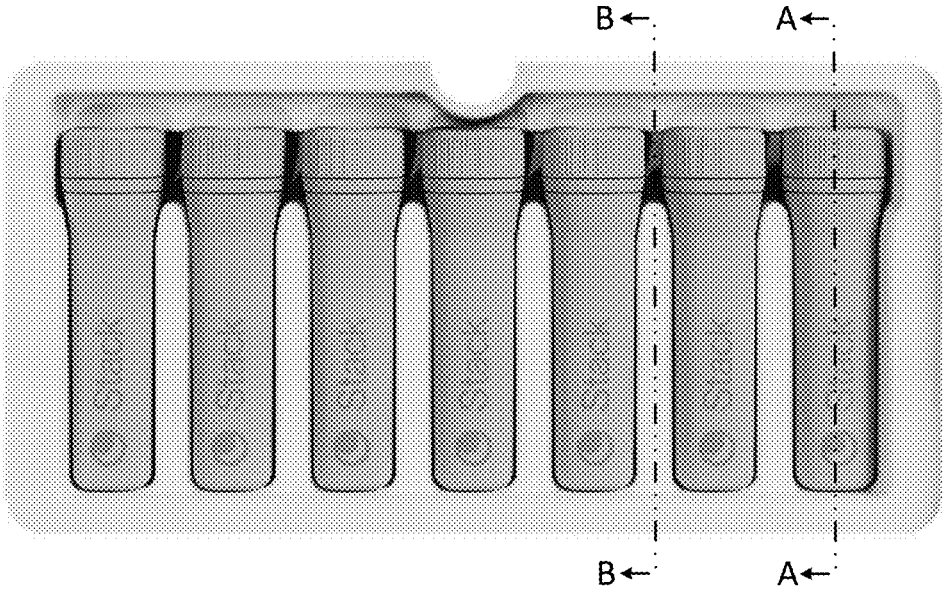
FIG. 4 is a top view of the exemplary tray of FIG. 3.
Figure 5:
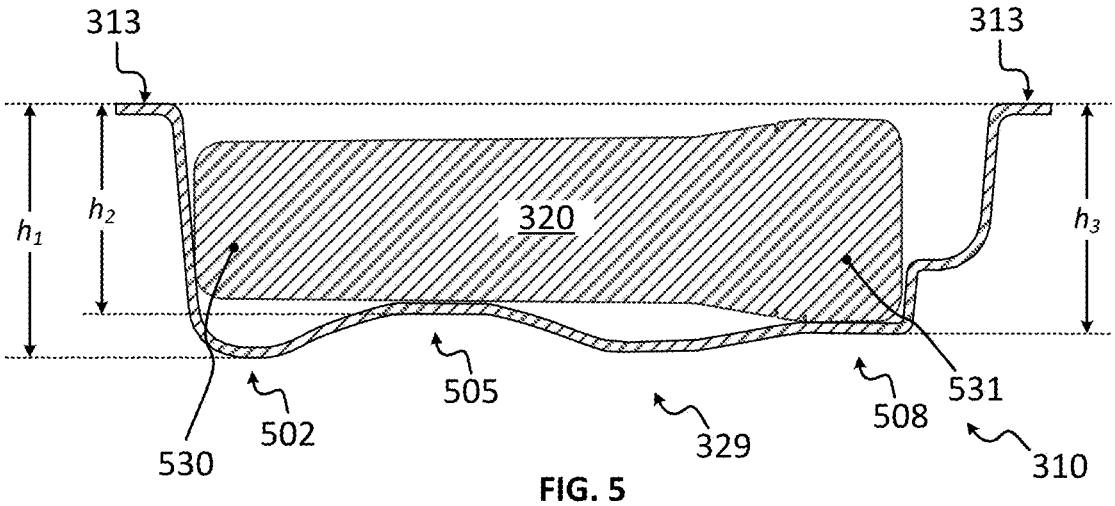
FIG. 5 is a sectional view of the exemplary tray of FIG. 4.
Figure 6:
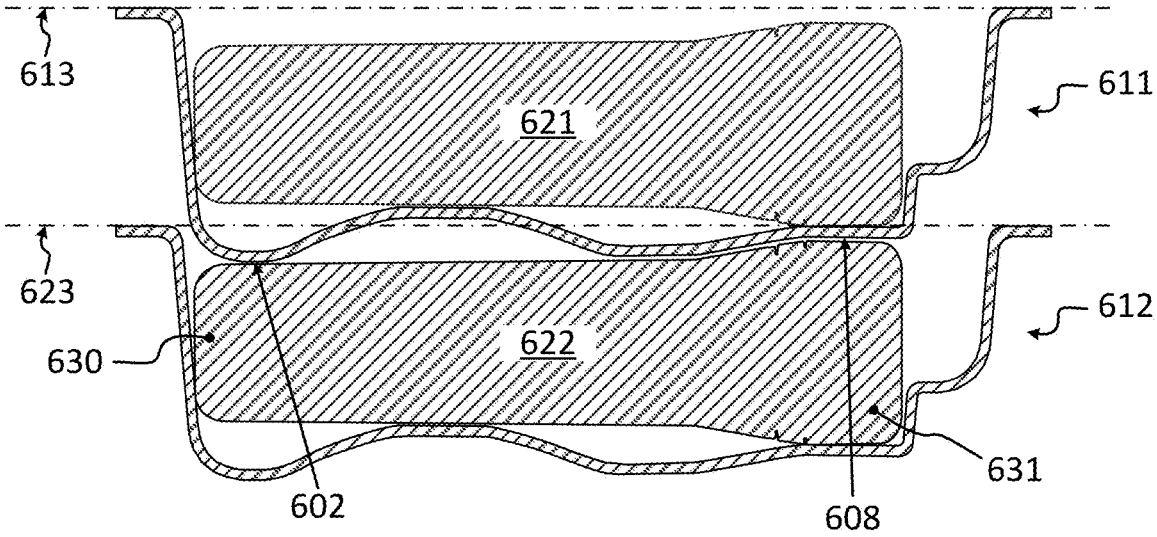
FIG. 6 is a sectional view of two stacked trays.
Figure 7:
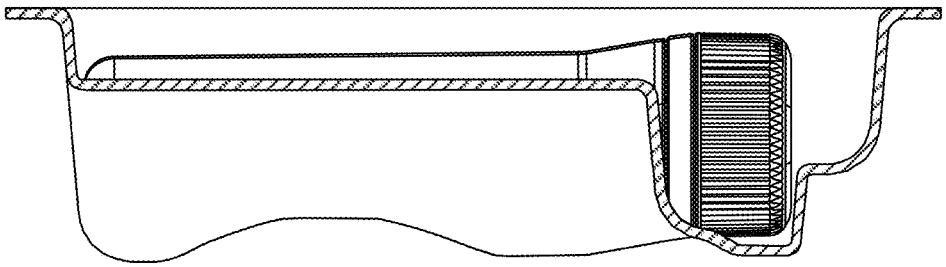
FIG. 7 is another sectional view of the exemplary tray of FIG. 4.

FIG. 5 illustrates the cross-section A-A of FIG. 4, and FIG. 7 illustrates the cross-section B-B of FIG. 4—each showing variation in the contoured bottom surface 329. Specifically, in some implementations, as shown in FIG. 5, the contoured bottom surface 329 of the tray 310 may have a first height, $h_1$, relative to the top planar rim 313 at a lower leg region 502, near a closed bottom 530 of the holder 320; a second height, $h_2$, relative to the top planar rim 313 at a mid-bore support region 505; and a third height, $h_3$, relative to the top planar rim 313 at an upper support region 508, near an removable top 531 of the holder 320.

With these variations in the contoured bottom surface 329, trays may be stacked in a parallel manner. That is, with reference to FIG. 6, an upper tray 611 with an upper holder 621 may rest on a lower tray 612 with a lower holder 622 such that the top planar rim 613 of the upper tray 611 is parallel to the top planar rim 623 of the lower tray 612; and this state may be facilitated by the dimensions of specific points of the contoured bottom surface of each tray, where the lower leg region 602 of the upper tray 611 rests on the closed bottom 630 of the lower holder 622 and the upper support region 608 of the upper tray 611 rests on the removable top 631 of the lower holder.

Figure 8:
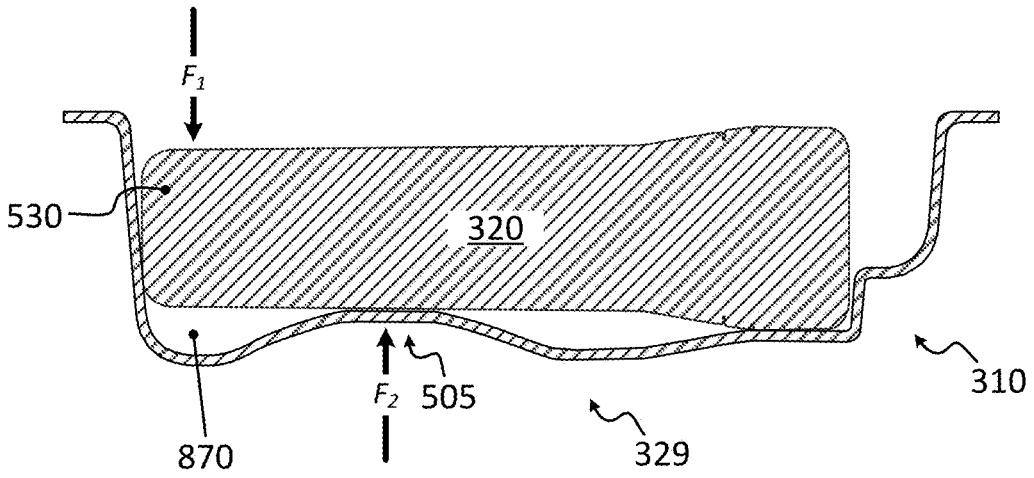
FIG. 8 is another sectional view of the exemplary tray of FIG. 5.
Figure 9:
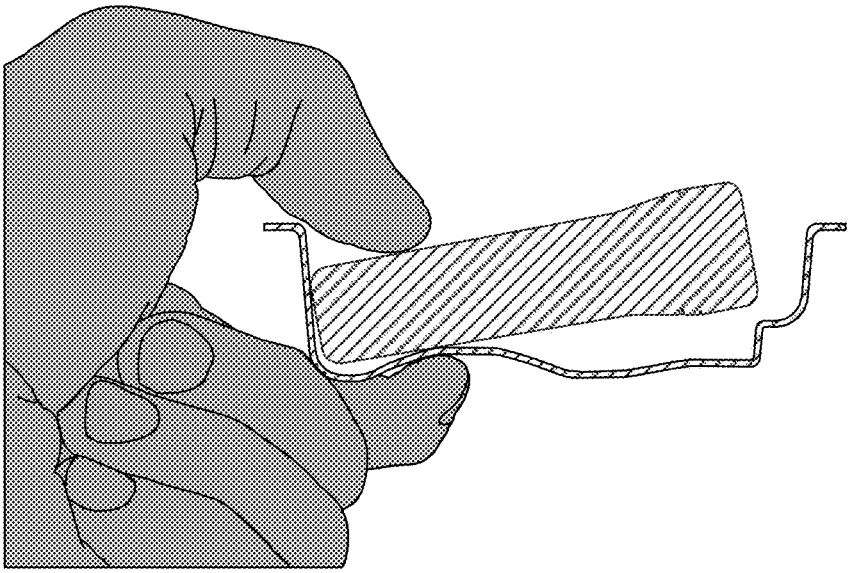
FIG. 9 depicts forces that may be applied to rotate a holder out of a receptacle.

FIG. 8 and FIG. 9 depict additional benefits that flow from the specific design of the contoured bottom surface 329 just described. In particular, application of opposing forces $F_1$ at the closed bottom 530 of the holder 320 and $F_2$ at the mid-bore support region 505 of the tray 310 may cause the holder 320 to rotate up (with the closed bottom 530 rotating into a gap 870) for easy removal of the holder 320 from the tray 310. As depicted in FIG. 9, such opposing forces $F_1$ and $F_2$ may be applied by a user's thumb and forefinger.

Figure 10:
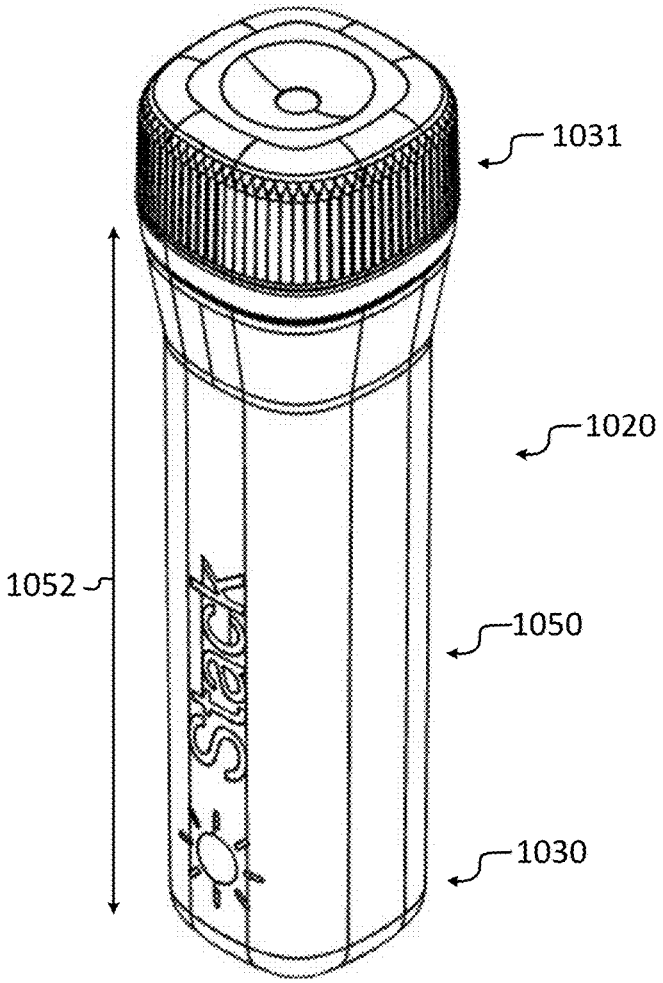
FIG. 10 illustrates an exemplary holder.
Figure 11:
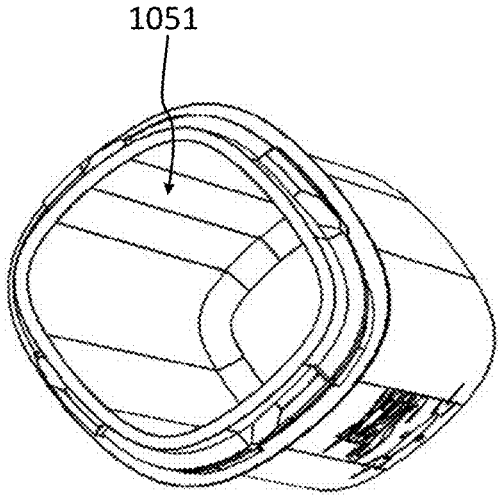
FIG. 11 is a perspective view showing an inside bore of the exemplary holder of FIG. 10.
Figure 12:
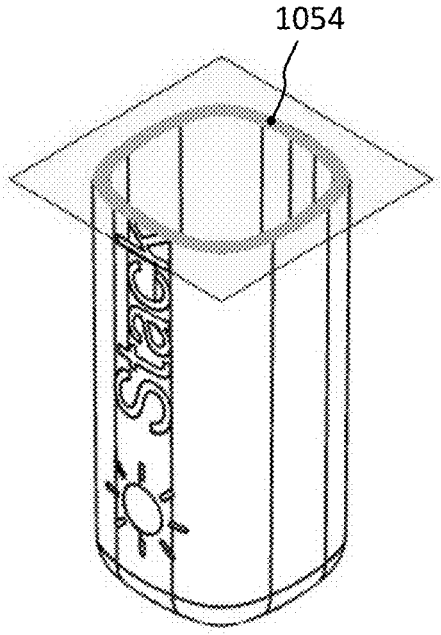
FIG. 12 is a cross-section of the exemplary holder of FIG. 10.
Figure 13:
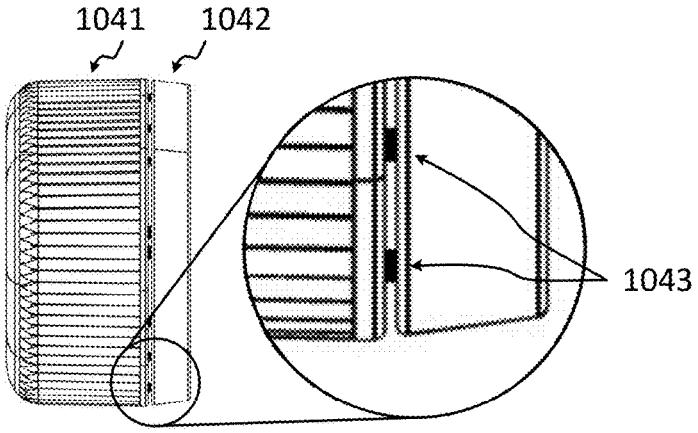
FIG. 13 illustrates details of an exemplary removable top.

FIGS. 10-15 illustrate additional details of an exemplary holder 1020. As shown in FIG. 10, an exemplary holder 1020 includes a retention portion 1050 with a closed bottom 1030 and a removable top 1031. In some implementations, the retention portion 1050 includes a continuously smooth inner bore 1051 along a length 1052 of the retention portion 1050; and this continuously smooth inner bore 1051 may have a substantially uniform cross-section 1054 along the length 1052. As depicted in FIG. 12, this substantially uniform cross-section 1054 may take the form of a squircle. In other implementations, the cross-section 1054 may take other forms.

This exemplary design provides several advantages over other designs: the squircle design of the holder 1020 may keep it from rolling off surfaces; and the continuously smooth inner bore 1051 may prevent contents from getting stuck in interior regions that would otherwise be characterized by sharper edges. Such a continuously smooth inner bore 1051 may be particularly advantageous when the holder 1020 is employed to store nutrients in a small form factor—such as, for example, as microbeads or microspheres.

The removable top 1031 may include two components—a top closure 1041 and a safety ring 1042. Initially, the top closure 1041 and safety ring 1042 may be connected to each other with break-away tabs 1043 when the connected top closure 1041 and safety ring 1042 are initially affixed to the holder 1020. In some implementations, when a user initially twists the top closure 1041 to open the holder 1020, the safety ring 1042 may be retained in place, and the break-away tabs 1043 may break, allowing the top closure 1041 and safety ring 1042 to be decoupled and the holder 1020 to be opened. Another component (not shown) may be provided—namely, a compressible sealing pad that is pinched between removable top 1031 and the retention portion of the holder 1020. Such a compressible sealing pad may provide a hermetic (or at least air-tight or humidity-tight) seal of the inner bore 1051 relative to an external environment.

Figure 14:
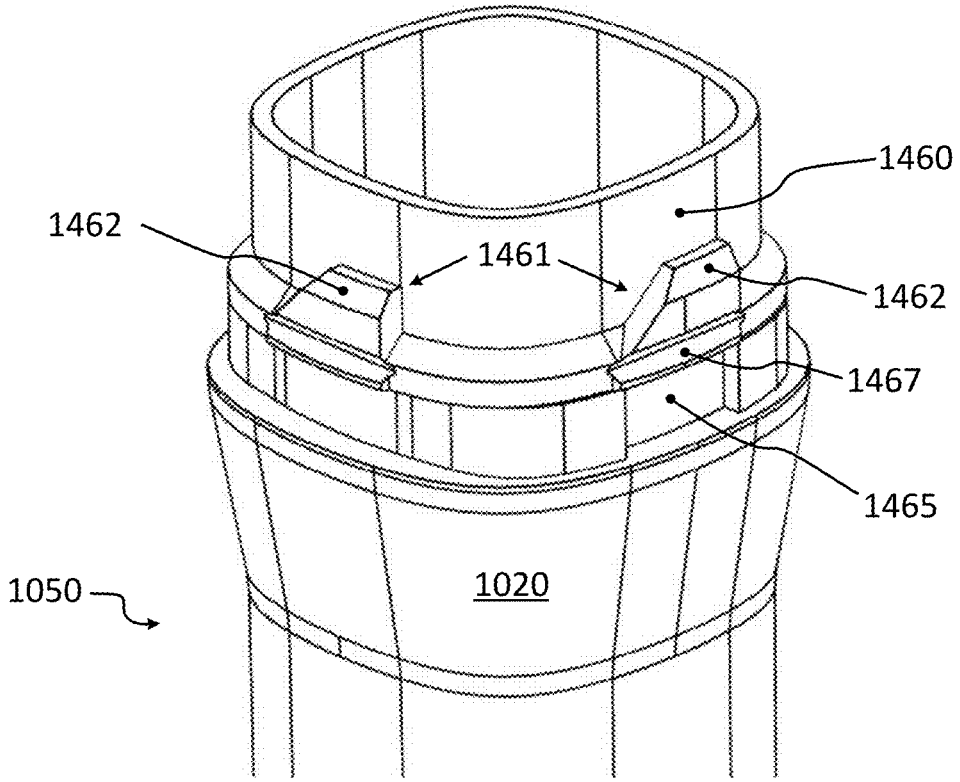
FIG. 14 illustrates additional details of the exemplary holder of FIGS. 10-11.
Figure 15:
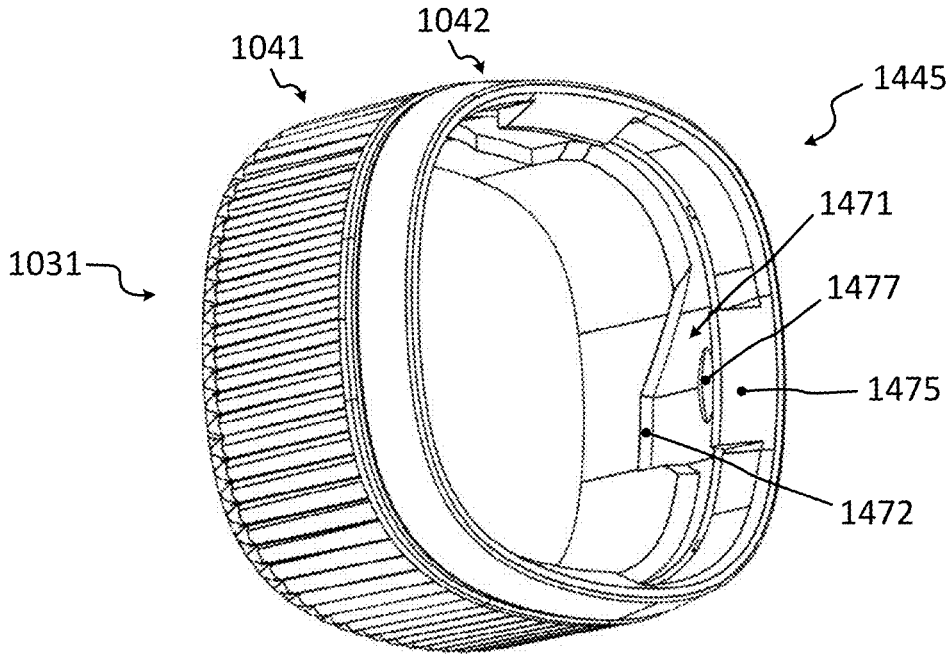
FIG. 15 illustrates additional details of the exemplary removable top of FIG. 13.
Figure 16:
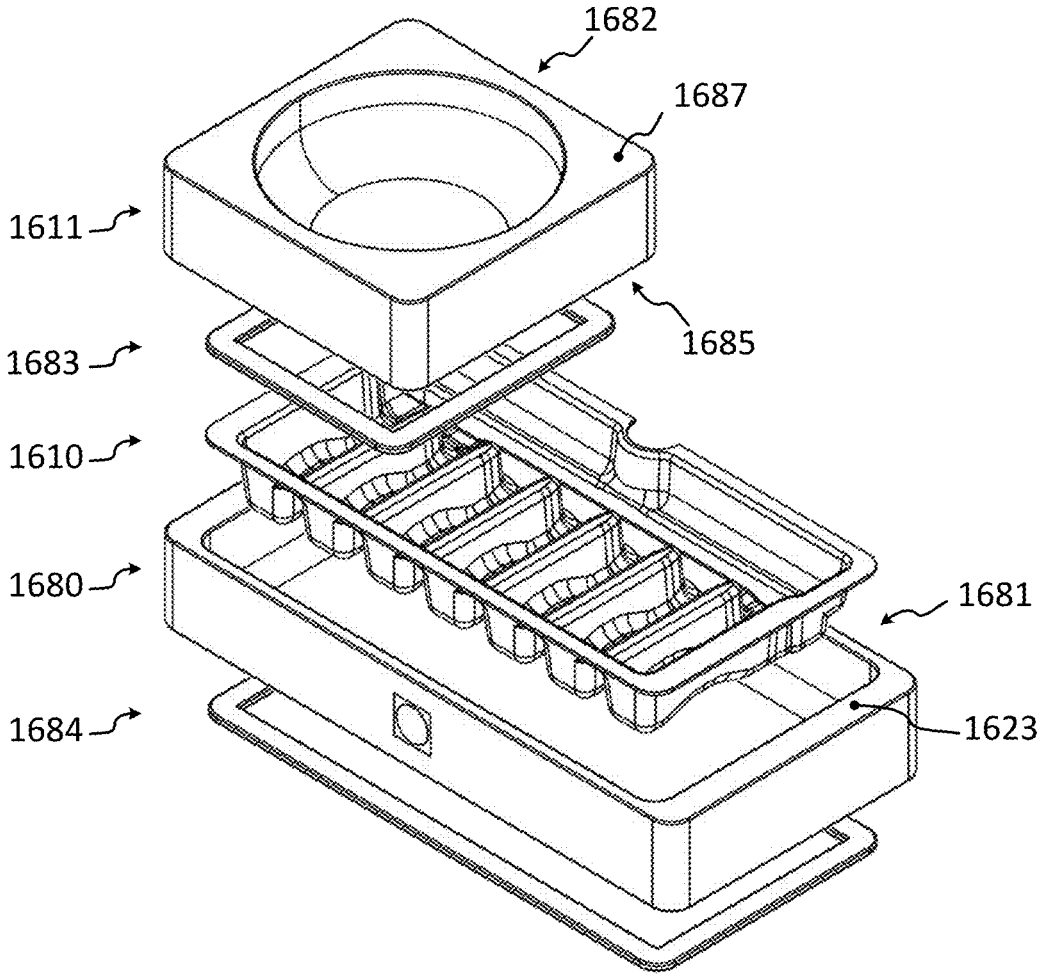
FIG. 16 is an exploded view of an exemplary display system.
Figure 17:
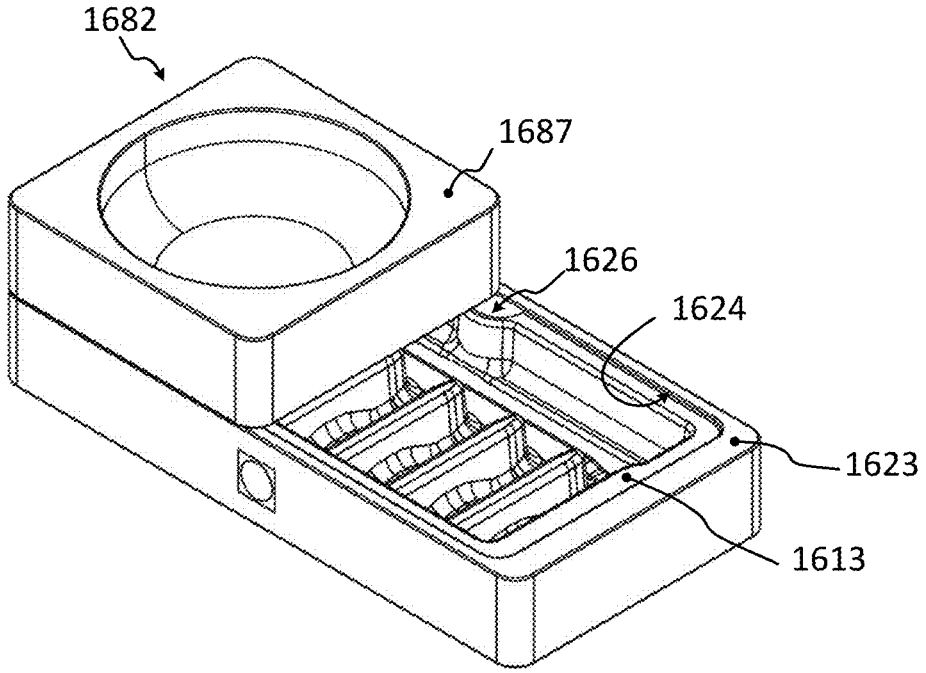
FIG. 17 illustrates an assembled view of the display system of FIG. 16.
Figure 18:
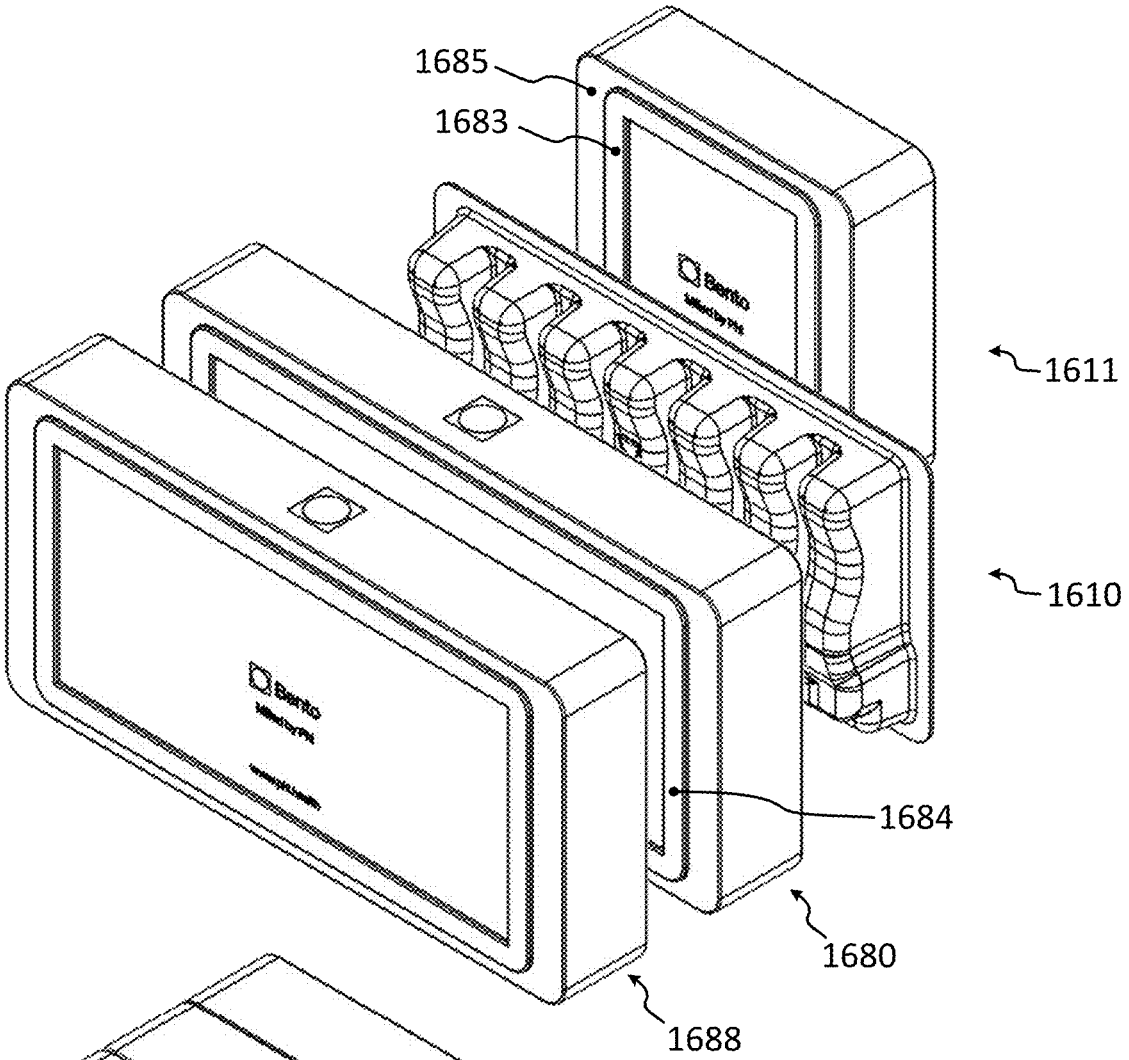
FIG. 18 is an exploded side view of a variation of the display system of FIG. 16.
Figure 19:
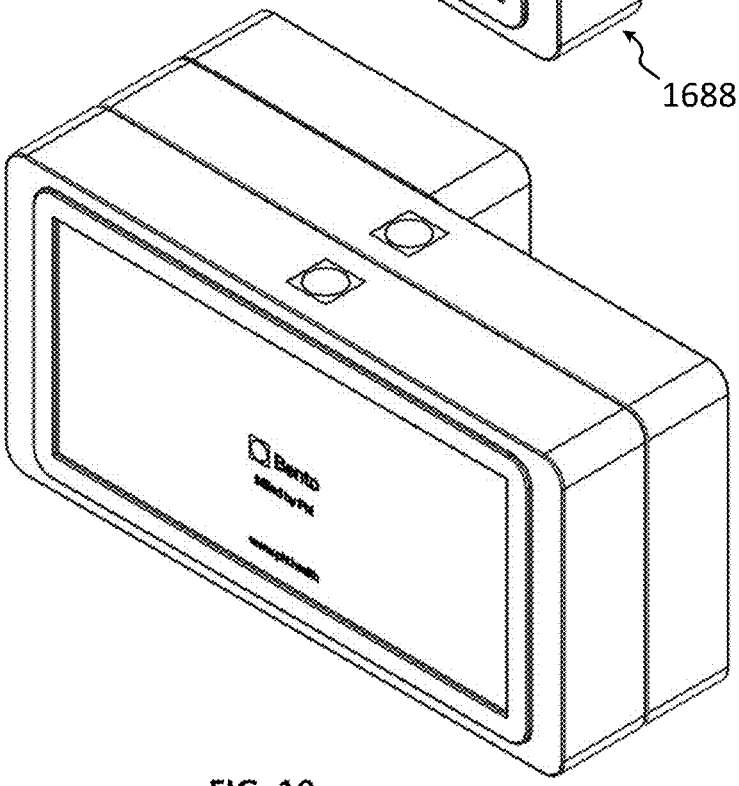
FIG. 19 is a side view of the variation of FIG. 18.

FIGS. 14 and 15 illustrate additional design details of the removable top 1031 and the manner in which it may be removably secured to the retention portion 1050 of a holder 1020. An exterior surface 1460 of a top portion of the holder 1020 may include thread ramps 1461 that are configured to engage with thread grooves 1471 in an inner recess 1445 of the removable top 1031 when the removable top 1031 is disposed on the holder 1020. To facilitate engagement of the removable top 1031 with the holder 1020, chamfered edges 1462 may be provided on the thread ramps 1461, and chamfered ridges 1472 may be provided on the thread grooves 1471. The holder 1020 may include a snap-fit retention recess 1465 to secure a corresponding snap-fit tab 1475 on the removable top 1031 to secure the safety ring 1042 to the retention portion 1050. In operation, when the removable top 1031 is disposed on the retention portion 1050, and the removable top 1031 is twisted by a user to remove the removable top 1031, the snap-fit tab 1475 remains engaged with the snap-fit retention access 1465, while the thread ramps 1461 push the corresponding thread grooves 1471 of the removable top 1031 up and away from the retention portion 1050, causing a separation of the top closure 1041 from the safety ring 1042. After the top closure 1041 has been separated from the safety ring 1042, the top closure 1041 may be re-coupled to the retention portion 1050—specifically, in some implementations, a snap-fit detent 1467 on the retention portion 1050 may engage with a snap-fit groove 1477 on the removable top 1031.

FIGS. 16-19 illustrate additional exemplary components of a system, in some implementations. In particular, a display container 1680 may be provided that is configured to snugly accommodate a tray 1610 within a cavity 1681. ("Snuggly accommodate" may mean to accommodate with just enough margin to facilitate insertion of the tray 1610 into the display container 1680 or removal of the tray 1610 from the display container 1680, with little movement permitted of the tray 1610 relative to the display container 1680 when the tray 1610 is disposed in the display container 1680.) In some implementations, the display container 1680 includes an upper perimeter edge 1623, and it may be configured such that a spacing gap 1624 exists between a top planar rim 1613 of the tray 1610 and the upper perimeter edge 1623. To facilitate removal of the tray 1610 from the display container 1680, the tray 1610 may include an access cutout 1626.

A system may further include a secondary holder 1611 that has a receptacle 1682 cut into a top surface 1687 (e.g., for storing small objects that are regularly used each day in conjunction with users consuming nutrients in the tray 1610, such as, for example, keys or a wallet). The secondary holder 1611 may also include an alignment boss 1683 on a secondary-holder bottom surface 1685, which, in some implementations, may be configured to be snugly accommodated within the spacing gap 1624 of the display container 1680. A display-container boss 1684 may also be snugly accommodated within the spacing gap (not shown) of a second display container 1688 (see FIGS. 18-19).

Figure 20:
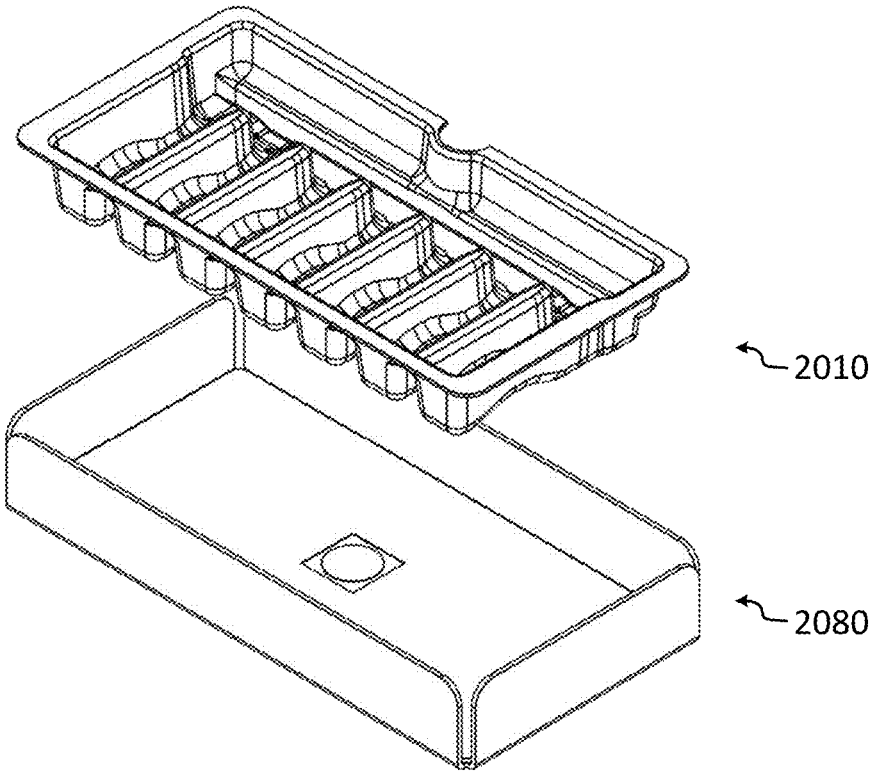
FIG. 20 is an exploded view of another display system.
Figure 21:
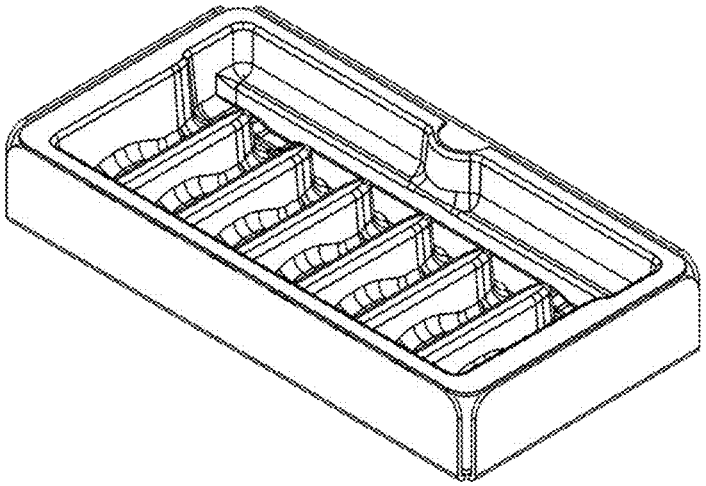
FIG. 21 illustrates an assembled view of the display system of FIG. 20.

FIGS. 20-21 illustrate another exemplary display container 2080 with another geometry that may also be configured to snugly accommodate a tray 2010.

Several implementations have been described with reference to exemplary aspects, but it will be understood by those skilled in the art that various changes may be made and equivalents may be substituted for elements thereof without departing from the contemplated scope. "About" or "approximately" may mean within 1%, or 5%, or 10%, or 20%, or 50%, or 100% of a nominal value; "substantially" may mean within 1%, or 5%, or 10% or 20% of a nominal value; vitamins, supplements and nutrients are disclosed, but some implementations could also apply to medications; various materials could be employed for the components described herein, including metals, woods, simulated woods, plastics, polymers, rubber, pulp packaging, cardboard, paper, etc.; a contoured bottom surface may have other contours or contact points; different numbers of holders may be provided; holders and trays may have different shapes; different numbers of holders may be provided to users at a given time and/or at a specific frequency; the form of nutrients contained with holders may vary; different forms may be combined or provided in different holders.

Many other variations are possible, and modifications may be made to adapt a particular situation or material to the teachings provided herein without departing from the essential scope thereof. Therefore, it is intended that the scope include all aspects falling within the scope of the appended claims.

What is claimed is:

1. A system, comprising:

a plurality of holders; and a tray having a plurality of receptacles, each receptacle of which is configured to removably receive one of the plurality of holders;

wherein each holder has a retention portion with outer walls that enclose a continuously smooth inner bore and that is characterized by a holder length, a closed bottom and a removable top; wherein the continuously smooth inner bore has, across the length, a substantially uniform cross-section in the form of a squircle; wherein the holder has, on an exterior surface at the removable top, a plurality of thread ramps, a plurality of snap-fit detents, and a plurality of snap-fit retention recesses; the holder further comprising a removable top cap having a top closure portion and a bottom safety ring that is coupled to the top closure portion with one or more break-away tabs; an inner recess of the removable top cap having a plurality of thread grooves that interface with the plurality of thread ramps, a plurality of snap-fit grooves that interface with the plurality of snap-fit detents, and a plurality of snap-fit tabs that interface with the plurality of snap-fit retention recesses;

wherein the tray has a top planar rim; each receptacle in the plurality of receptacles has a contoured bottom surface whose height varies relative to the top planar rim from a first height at a lower leg region, a second height at a mid-bore support region, and a third height at an upper support region; and the top planar rim further includes at least one access cutout along a perimeter of the top planar rim.

2. The system of claim 1, further comprising a shipping package that holds a plurality of trays, each tray in the plurality of trays removably securing holders within each receptacle, wherein the plurality of trays are stacked on top of each other, such that the bottom contoured surface of an upper tray contacts holders disposed within a lower tray at the lower leg region and the upper support region, thereby allowing the plurality of trays to be stacked with their respective top planar rims being parallel to each other.

3. The system of claim 2, wherein the shipping package holds a first stack of trays and a second stack of trays, wherein when the first stack of trays is disposed 180 degrees relative to the second stack of trays, the access cutouts in the first stack of trays aligns with the access cutouts in the second stack of trays.

4. The system of claim 2, further comprising a display container that is configured to snugly receive one tray from the plurality of trays in the shipping package.

5. The system of claim 4, wherein the display container has an upper perimeter edge, and a cavity that is configured to receive the one tray such that the upper planar rim of the one tray is spaced apart from and below the upper perimeter edge by a spacing gap.

6. The system of claim 5, further comprising a secondary holder having a top surface, a receptacle that extends down from the top surface, and a secondary-holder bottom surface; wherein an alignment boss extends down from the secondary-holder bottom surface a distance equal to or less than the spacing gap and is configured to snugly engage with the cavity when the secondary holder is stacked on top of the display container.

7. The system of claim 1, wherein each of the thread ramps in the plurality of thread ramps has a chamfered edge, and each of the thread grooves in the plurality of thread grooves has a corresponding chamfered recess.

8. The system of claim 7, wherein the thread ramps, thread grooves, chamfered edges and chamfered recesses are configured such that the removable top cap can be snap-fit onto the retention portion such that the thread ramps are disposed in the thread grooves.

9. The system of claim 7, wherein the thread ramps and thread grooves are further configured such that once the removable top cap is snap-fit onto the retention portion, rotation of the removable top cap relative to the retention portion causes the removable top cap to separate from the retention portion, causing the break-away tabs to break, thereby separating the top closure portion and the bottom safety ring.

10. The system of claim 9, wherein the snap-fit grooves and snap-fit detents are configured to recouple, with a snap fit connection, the removable top cap to the retention portion even after the break-away tabs are broken.

11. The system of claim 1, further comprising a compressible sealing pad disposed between the retention portion and the removable top cap.

12. The system of claim 1, wherein the contoured bottom surface is configured such that when a specific holder is disposed in a specific receptacle, opposing forces applied at the mid-bore support region of the specific receptacle and the closed bottom of the specific holder cause the removable top of the specific holder to rotate upward to facilitate extraction of the specific holder from the specific receptacle.

13. The system of claim 12, wherein the contoured bottom surface of the specific receptacle is configured to create a lower-leg gap between the contoured bottom surface and the closed bottom of the specific holder, to facilitate upward rotation of the specific holder when the opposing forces are applied.

* * * * *